US008910800B1

(12) United States Patent
Bickford

(10) Patent No.: US 8,910,800 B1
(45) Date of Patent: Dec. 16, 2014

(54) TRANSPARENT SPORTS CAP DISPLAY RACK AND ADJUSTABLE BILL SHAPER

(71) Applicant: Dennis Bickford, Farmington, NM (US)

(72) Inventor: Dennis Bickford, Farmington, NM (US)

( * ) Notice: Subject to any disclaimer, the term of this patent is extended or adjusted under 35 U.S.C. 154(b) by 0 days.

(21) Appl. No.: 14/170,552

(22) Filed: Jan. 31, 2014

(51) Int. Cl.
*A47F 7/06* (2006.01)
*A47G 25/10* (2006.01)

(52) U.S. Cl.
CPC ..... *A47G 25/10* (2013.01)
USPC ..... 211/32

(58) Field of Classification Search
USPC ..... 211/30, 31, 32, 33, 41.1, 41.2, 45, 50, 211/60.1, 70.5, 70.8, 74, 75, 85.7, 126.15; 206/8, 9; 248/220.21, 223.41, 238, 248/309.1; D6/309.1, 320, 570, 571, 572; 223/84
See application file for complete search history.

(56) References Cited

U.S. PATENT DOCUMENTS

| | | | | | |
|---|---|---|---|---|---|
| 1,176,508 | A | * | 3/1916 | Williams | 211/30 |
| 3,018,001 | A | * | 1/1962 | Combs | 211/59.2 |
| 3,078,484 | A | * | 2/1963 | Briggs | 15/21.1 |
| D204,344 | S | * | 4/1966 | Schendal | D6/570 |
| 3,333,708 | A | * | 8/1967 | Leblanc et al. | 211/85.1 |
| 4,264,013 | A | * | 4/1981 | Vollmer | 211/85.2 |
| 4,673,153 | A | * | 6/1987 | Hilty et al. | 248/231.81 |
| D310,926 | S | * | 10/1990 | Bass et al. | D6/570 |
| 5,086,931 | A | * | 2/1992 | Cobb | 211/32 |
| D328,681 | S | * | 8/1992 | Radosevich | D6/571 |
| D332,025 | S | * | 12/1992 | Caldwell et al. | D6/570 |
| 5,188,325 | A | * | 2/1993 | Hilty et al. | 248/224.8 |
| D338,127 | S | * | 8/1993 | Bass et al. | D6/571 |
| 5,244,102 | A | * | 9/1993 | Koenig | 211/32 |
| 5,295,588 | A | * | 3/1994 | Neirinckx | 211/32 |
| 5,344,003 | A | * | 9/1994 | Park | 206/8 |
| 5,348,166 | A | * | 9/1994 | Lema | 211/30 |
| 5,396,994 | A | * | 3/1995 | Fitzgerald | 211/32 |
| 5,411,144 | A | * | 5/1995 | Deupree | 211/30 |
| 5,450,967 | A | * | 9/1995 | Mallory | 211/30 |
| D372,380 | S | * | 8/1996 | Montalbo et al. | D6/467 |
| 5,685,465 | A | * | 11/1997 | Berardis | 223/84 |
| 5,727,694 | A | * | 3/1998 | Larson | 211/33 |
| 5,762,206 | A | * | 6/1998 | Leichter | 211/32 |
| 6,311,879 | B1 | * | 11/2001 | Rigler et al. | 223/84 |
| 6,422,400 | B1 | * | 7/2002 | Miller | 211/32 |
| D473,125 | S | * | 4/2003 | Conroy | D8/367 |
| 6,840,411 | B2 | * | 1/2005 | Fritz | 223/24 |
| 6,935,517 | B1 | * | 8/2005 | Reed et al. | 211/85.7 |
| 7,665,616 | B1 | * | 2/2010 | Hobbie | 211/31 |
| D639,593 | S | * | 6/2011 | Perone et al. | D6/572 |
| 2004/0020881 | A1 | * | 2/2004 | Wuerth | 211/85.7 |
| 2006/0124563 | A1 | * | 6/2006 | Penson | 211/30 |

* cited by examiner

*Primary Examiner* — Joshua Rodden

(57) ABSTRACT

Multiple embodiments of an improved sports cap display rack comprising a comprehensive collection of serviceable features. It possesses an adjustable bill shaper, capable of shaping and maintaining a plurality of sports cap bills with varying degrees of curvature. The rack simultaneously displays the sports caps in a precise, uniform presentation, highlighting the crown indicia for artistic observation, assisting in the locating of specific caps concealed in a large collection. From a manufacturing standpoint, the unique design of the interchangeable sidewall assemblies (20A) FIG. 1 or (20B) FIG. 2 lowers retooling costs and reduces packaging, shipping and storage expense. The design of the end slot intervals (38) enhances the coupling of additional racks, rendering them suitable for small or large sized hat collections.

4 Claims, 4 Drawing Sheets

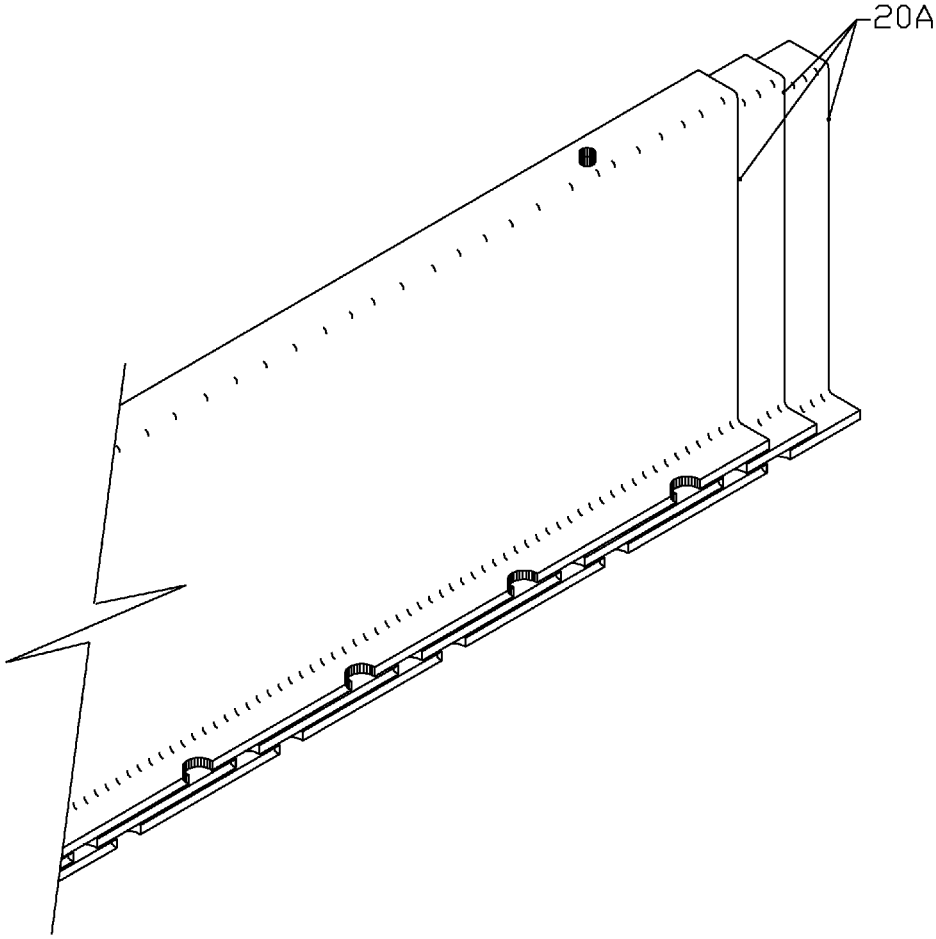
FIG. 1-A

TRANSPARENT SPORTS CAP DISPLAY RACK AND ADJUSTABLE BILL SHAPER

BACKGROUND

Prior Art

The following is a tabulation of some prior art that appears somewhat relevant:

| Pat. No. | Kind Code | Publ. Date | Inventor(s) |
|---|---|---|---|
| U.S. Pat. 6,311,879 | B 1 | 2001 November 06 | Jerry H. Rigler, Brenda J. Rigler |
| U.S. Pat. 6,840,411 | B 2 | 2005 January 11 | Wayne Fritz |
| U.S. Pat. 6,422,400 | B 1 | 2002 July 23 | Brett K. Miller |
| U.S. Pat. 8,020,712 | B 2 | 2011 September 20 | Kenneth B. Kopp, James T. Kopp, SR |
| U.S. Pat. 7,665,616 | B 1 | 2010 February 23 | Mathew M. Hobbie |
| U.S. Pat. 7,967,173 | B 2 | 2011 June 28 | Kenneth B. Kopp, James T. Kopp, SR. |

Many households have large collections of baseball-type sports caps fashioned with a bill. People collect caps at events and destinations from all over the world. Most caps are adorned with logos or indicia on the front of the crown which advertise businesses, promote sports teams or simply serve as a fond reminder of significant locations or events attended. Often these collections end up in boxes, heaped in a closet corner or scattered around a dusty garage. Any sense of pride in these souvenirs quickly dissolves once they become disfigured or soiled. Many people would like to preserve these collections in a display which protects and highlights them in an aesthetically pleasing fashion. Unfortunately, the present available commercial display options are not appealing to or practical for most individuals.

A significant need for sports cap organizers capable of displaying a wide array of various sized hat collections is commonly acknowledged in the arts. These displays should highlight the crown indicia for artistic observation as well as to facilitate the retrieval of a specific hat concealed in a large collection. Trying to find a particular hat in a large collection when the crown indicia is not exposed is like trying to find an object in a Bev Doolittle painting. Another desirable feature is the ability to shape cap bills into different configurations. Personal preferences range from completely flat bills to various degrees of bill curvature. Commercial demand solicits a simplistic, affordably priced design which displays the hats with a precise uniformity. Commercial success dictates the accomplishment of these features while maintaining a high profit margin.

Rigler discloses a bulky, horseshoe shaped, slotted device which either hangs from above, or stands in the floor supported by attached feet. When the caps are slotted, the crown insignia is not visible. This device is only capable of applying one distinct curvature to the bills. This system also requires a great deal of floor space to display a large collection of caps, rendering it prohibitive for most home collections.

One merely has to watch a PGA golf tournament to witness the multiple styles with which caps are donned today. A lot of the younger players seem to be gravitating towards flatter bill trajectories, while the senior players migrate towards the more traditional appearance, employing a broad spectrum of various curvatures. Style has become a personal identifier with some of today's successful athletes such as Ricky Fowler. People go to great lengths to shape and preserve their caps.

Fritz points out the lack of simplicity in the prior arts, emphasizing the complexities of previous devices. His use of retaining cylinders restricts the bill curvatures to one size. The cylinders are not capable of displaying today's ever popular flat bill configurations. When caps are stored in the cylinders, the crown indicia is hidden, making this design undesirable for displaying large collections.

Miller's design is very similar to Fritz's. His display also utilizes a hollow cylindrical system of shaping and displaying caps. His invention is very limiting, allowing no adjustment in bill curvature, due to the fact the bill shaper is made from a single sized hollow cylinder. His invention also has no provisions for displaying flat bills. The overall presentation occupies a lot of space and fails to blend in with its surroundings.

Kopp and Kopp SR. offer two different inventions that efficiently accommodate a plurality of caps. One is a loop system which is intended to shape cap bills while they are being displayed. The bills are loosely captured in the loops offering no consistency in the shaping process and no means to secure the caps in a uniform presentation. The Kopp's ring system offers a limited variation in bill curvature and lacks any means of displaying flat bills. Since this system necessitates being hung away from any wall structure, it occupies central floor space. This type of display is forever being bumped and jostled by people traffic. This results in a constant, labor intensive requirement for rearranging the display, as the caps are not secured in the rings. The initial construction of this system is also labor intensive and would be very costly to mass produce.

Hobbie's design shows some ability to shape various bill curvatures, however, most collectors prefer only one particular bill curvature. Each of Hobbie's devices displays three caps, all of a different bill curvature. They have some adjustment ability but lack flexibility in display options. They would not be efficient in displaying a large collection, nor would they present a uniform, artful, appearance.

Advantages

Thus several advantages of one or more aspects of the "Transparent Sports Cap Display Rack and Adjustable Bill Shaper" are as follows: has a simplistic design; can be mass produced at a relatively low cost; has fashion appeal; can accommodate large or small collections; creates packaging, shipping and storage efficiencies, and has broad adjustment capability in the bill-shaping process. These and other advantages of one or more aspects will become apparent from a consideration of the ensuing description and accompanying drawings.

SUMMARY

The enginuity of one or more embodiments of the "Transparent Sports Cap Display Rack and Adjustable Bill Shaper" is that it independently meets or exceeds all of the accomplished features of the prior art, in its total aggregate.

DRAWINGS

Figures

FIG. 1A is a perspective view illustrating the stacking features of the first embodiment.

Figure 1:
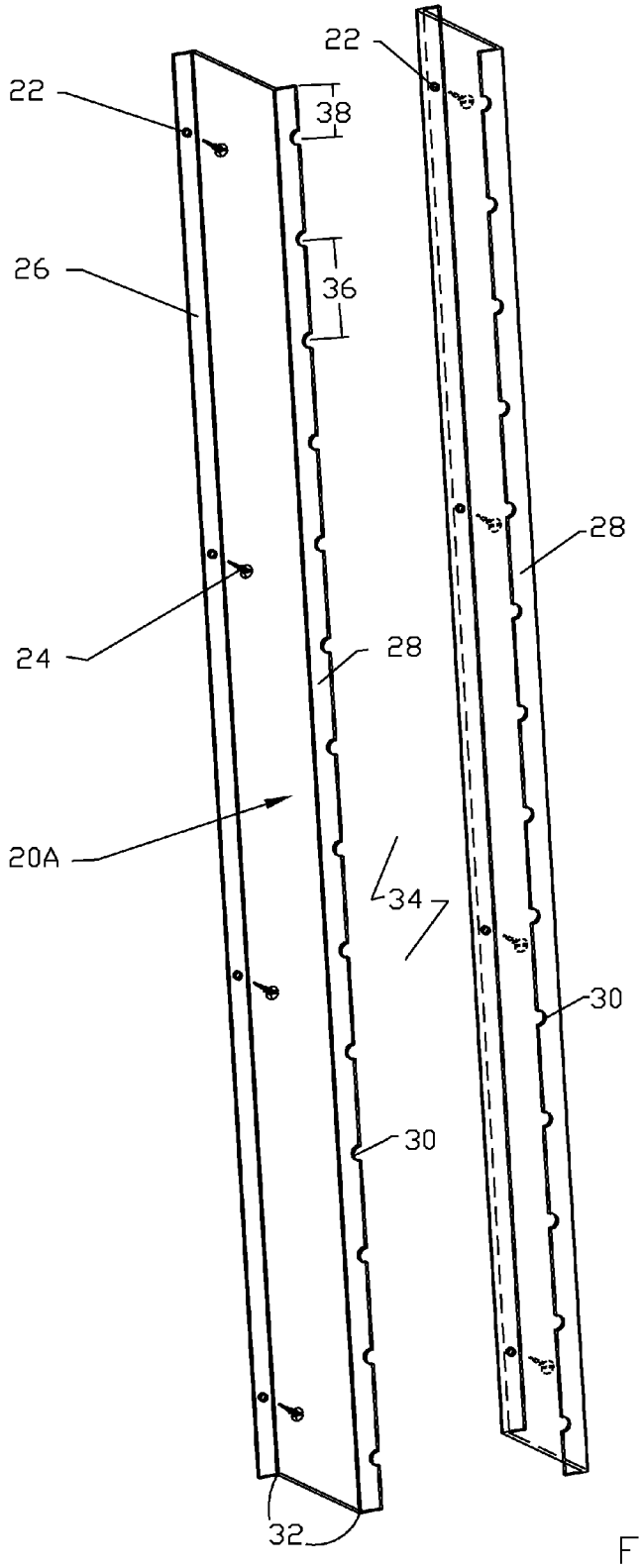
FIG. 1 is an isometric view of the first embodiment.

| Drawings - Reference Numerals | |
|---|---|
| 20A | sidewall assembly |
| 20B | sidewall assembly |
| 22 | aperture |
| 24 | fastener |
| 26 | rear mounting flange |
| 28 | front bill retainer flange |
| 30 | bill retainer slot |
| 32 | sidewall |
| 34 | rear mounting surface |
| 36 | bill retainer slot interval |
| 38 | bill retainer end slot interval |
| 40 | invaginated rear mounting flange |
| 42 | cap bill edge |
| 44 | rearward portion of folded cap |

DETAILED DESCRIPTION

First Embodiment—FIGS. 1-1A

FIG. 1 shows an isometric view of the first embodiment of the "Transparent Sports Cap Display Rack and Adjustable Bill Shaper". The first embodiment consists of a pair of sidewall assemblies 20A, each of a two tiered continuous molding. They are presently molded or formed from 3 mm, clear acrylic sheet. Both sidewall assemblies are identical in design, allowing any sidewall assembly to be substituted for either side of a two piece rack. This results in the elimination of multiple retooling costs, consequently reducing the manufacturing cost of this embodiment. One sidewall assembly is inverted longitudinally 180 degrees from the opposing sidewall assembly and they are both mounted parallel to each other and at the same height. By increasing or decreasing the physical spacing between the two sidewall assemblies during the mounting procedure, a new dimension in the diversity of adjustable bill curvatures can be obtained. The results can range between flat bills and highly curved bill presentations.

Again, FIG. 1 shows a rear mounting flange 26 molded at a 90 degree angle to the outside of a sidewall 32, perforated with four apertures 22, by which appropriate fasteners 24 pass through to secure the sidewall assembly to a wall, ceiling, counter, door or other desirable rear mounting surface 34. Wood screws are the illustrated fastener in FIG. 1; however, options such as wallboard fasteners, glue, double-sided tape or other suitable fasteners may be substituted as the application dictates. The sidewall 32 is a connecting medium for the rear mounting flange and a front bill retainer flange 28. Its depth also provides an enclosed sanctuary for the containment of folded sports cap bodies. The front bill retainer flange 28 is molded at a 90 degree angle to the inside of the sidewall 32 and opposes the rear mounting flange. A row of 14 bill retainer slots, notch's, grooves, furrows 30 are milled into the front bill retainer flange at an equidistant bill retainer slot interval 36. The bill retainer slots, presently, are half-circles with a 4.49580 mm radius. The bill retainer slots could be of many various designs, including square, rectangular, triangular, v-shape or differently sized half-circles, etc. The bill retainer slots could also be milled at varying depths to create an additional method of adjusting the degree of bill curvature. A bill retainer end slot interval 38, the spacing interval as measured from either end of the front bill retainer flange to the nearest bill retainer slot, is calculated as one-half of the bill retainer slot interval. Consequently, when two of these display racks are mounted adjacently end to end, the half-interval spacing causes the bill retainer end slots to match up and maintain the same spacing as the bill retainer slot interval, resulting in a uniform display. Note: the spacing ratio between the bill retainer slot interval and the bill retainer end slot interval is key to the identity and substitution features of the sidewall assembly. The sidewall assemblies of the present embodiment are approximately 91.5 cm in length, 10.5 cm in width, and 4.2 cm in height. It will be obvious to anyone skilled in the art that these dimensions could be changed to accommodate the display of more or fewer caps or to vary the distance between the caps.

FIG. 1A illustrates the unique stacking configuration that is created by the design of the main component of this embodiment, the sidewall assembly. The simplicity of this tiered design allows hundreds of the assemblies to meld together eliminating unusable packaging volume. The ability to stack these units in bulk fashion significantly reduces packaging, shipping and storage costs.

OPERATION

First Embodiment—FIGS. 1, 1A

The present embodiment illustrated in FIG. 1 relates to a display device for sports type caps with bills and, more particularly, to a storage and display device which also shapes and maintains the bill curvature of the caps while they are being stored. By retaining the bill at the desired curvature, over time the resilience of the bill is overcome, allowing it to retain a rounded shape for hours. After the wearer takes off the cap, the bill of the cap is typically returned to the display rack for maintenance of the bill's curvature.

Figure 3:
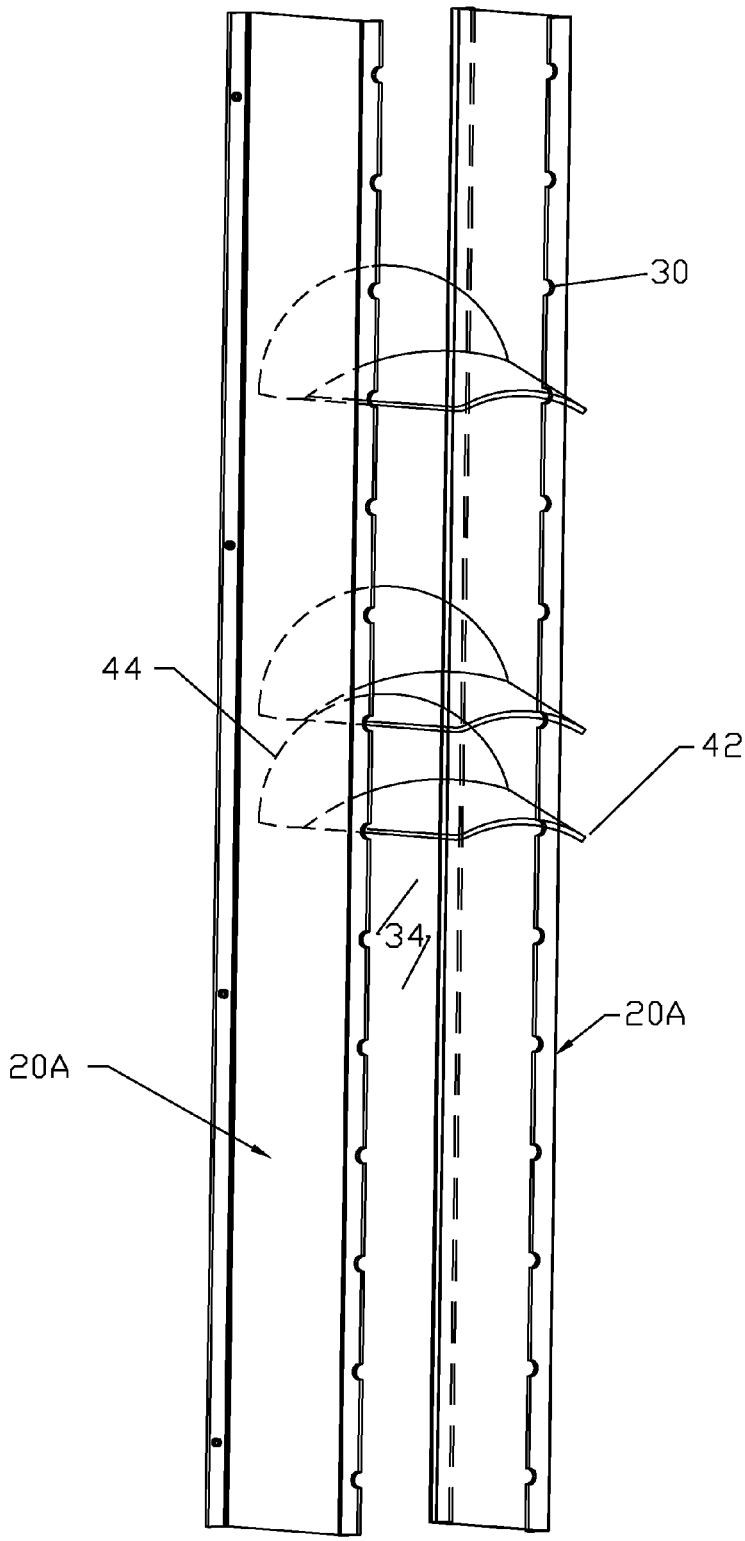
FIG. 3 is a perspective view illustrating a utilization rendering.

Best illustrated by referring to FIG. 3, the cap is readied for display and maintenance by collapsing or folding a rearward portion of the cap 44 head cover towards the visor into the forward cap head cover portion, thus fully exposing the crown indicia for display. Now, keeping the cap in a somewhat level position, simply place the rear portion of the folded cap 44 to the rear of the display rack, against a rear mounting surface 34 between the two mounted sidewall assemblies 20A. The front of the crown should be facing upright and the top of the bill should be in a convex position. Snap one side of a cap bill edge 42 into a bill retainer slot 30 of one sidewall assembly at the desired height. Then, at the same level, snap the opposite side of the cap bill edge into the corresponding bill retainer slot of the other sidewall assembly. The friction of the rear mounting surface, coupled with the clamping effect of the bill retainer slots on the brim of the cap, provide a method to secure the cap in a precise, uniform, manner which displays the crown indicia for observation and the bill for shaping the curvature. Each cap may be removed or inserted with minimal disturbance to the adjacent caps.

Each rack in the present embodiment holds 14 caps. Multiple racks can be mounted side by side and/or vertically adjacent, end to end, to provide an attractive display for a multiplicity of caps. In a clustered formation or as a separate unit, the display racks are barely noticeable due to the transparency of the acrylic. The main focus is drawn to the uniform display of the hat collection.

There are two main components of this embodiment. Both are sidewall assemblies 20A, FIG. 1, identical in design and molded of 3 mm clear acrylic sheet. One sidewall assembly is inverted longitudinally 180 degrees to the other sidewall assembly and they are both mounted parallel to each other and at the same height. They comprise the display rack and contain the folded body of the caps within.

Still referring to FIG. 1, rear mounting flanges 26 provide mounting surfaces for the sidewall assemblies which are coupled to another desirable rear mounting surface 34 using appropriate fasteners 24, through apertures 22 in each flange or by other available attachment methods. Before mounting, the sidewall assemblies should be properly spaced in width to produce the desired curvature of the cap bills resulting from the bill shaping process. This feature provides a highly adjustable range of cap bill curvatures which I have found to be lacking in the present arts. The front bill retainer flange 28 encompasses 14 bill retainer slots 30 in the present embodiment, a mechanism devised to anchor and retain the cap bills for the display and shaping of the bill curvature. Bill retainer slot intervals 36 maintain a uniform separation between the cap bills so that the crown indicia is presented for observation. Bill retainer end slot interval 38, measured from either end of the front bill retainer flange to the nearest bill retainer slot, calculates to be one half of the bill retainer slot interval. If two racks are butted up against each other end to end, the bill retainer slots on each end will be adjacent. Due to the half-interval spacing, the bill retainer slots on each end maintain the same equidistant interval as the remaining bill retainer slots, resulting in a uniform display. The sidewall 32 for each sidewall assembly is a connecting medium for the front bill retainer flange 28 and the rear mounting flange 26. Its depth also provides an enclosed sanctuary for the storage of the folded sports cap bodies.

DETAILED DESCRIPTION

Figure 2:
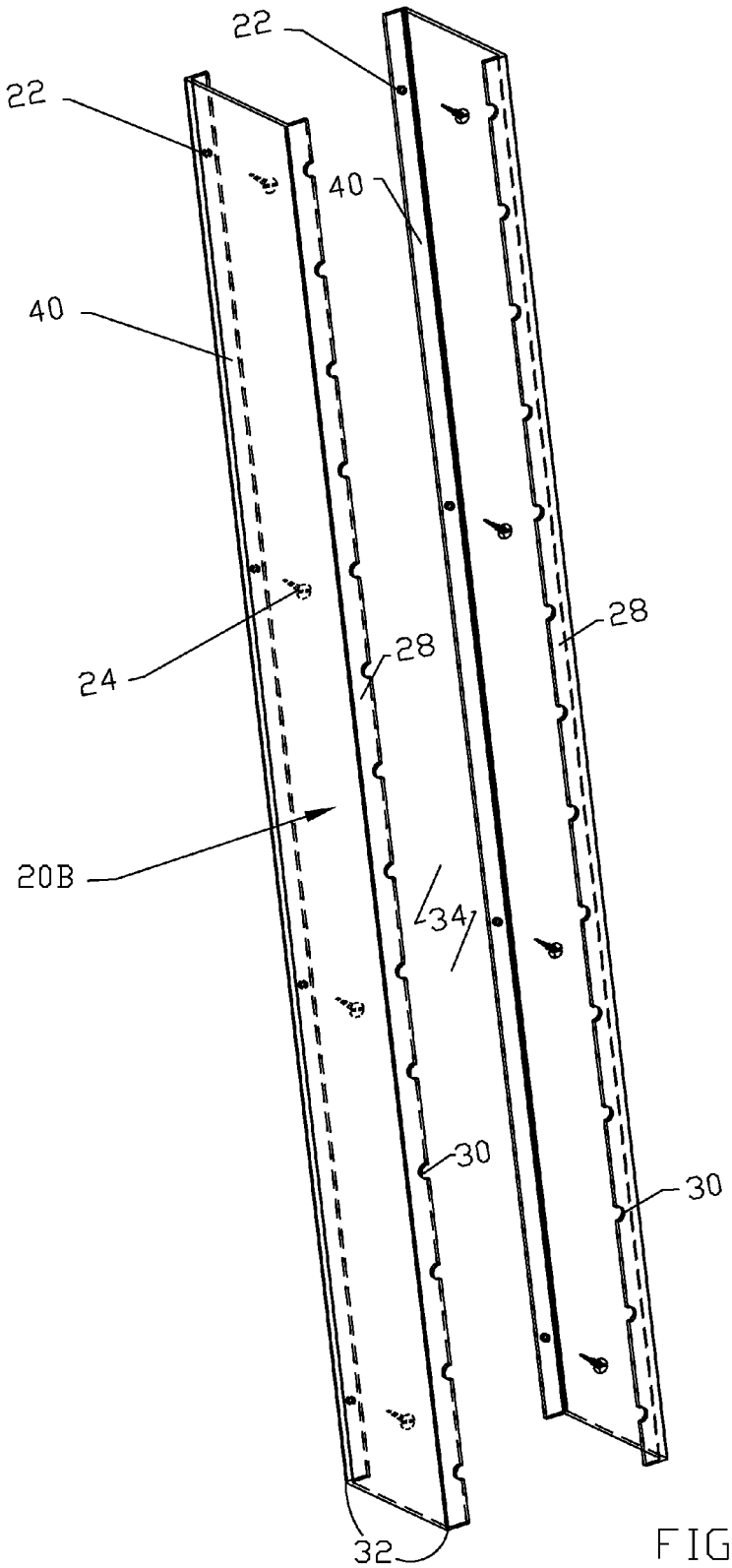
FIG. 2 is an isometric view of a second embodiment, whereas, the rear mounting flange is invaginated in relation to the rear mounting flange of the first embodiment.

Second Embodiment—FIG. 2

FIG. 2 shows an isometric view of the second embodiment of a "Transparent Sports Cap Display Rack and Adjustable Bill Shaper". This embodiment is a two piece display rack consisting of a pair of identical sidewall assemblies 20B, each having an invaginated rear mounting flange 40 in relation to the rear mounting flange of the first embodiment.

OPERATION

Second Embodiment—FIG. 2

The invaginated rear mounting flange is molded at a 90 degree angle to the inside of the sidewall 32 and opposing the rear mounting flange of the first embodiment. The advantage is that the flange is hidden when the display has a full occupancy of caps. Multiple display racks can also be mounted side by side, eliminating any gap between the display racks. The disadvantage is a loss of efficiency in the packaging and shipping process.

CONCLUSION, RAMIFICATIONS, AND SCOPE

Thus, the reader will see that at least one embodiment of the Transparent Sports Cap Display Rack and Adjustable Bill Shaper has immense fashion appeal due to its simplistic design. It has broad flexibility in bill shaping curvatures and is very efficient in terms of packaging, shipping and storage requirements. This design can be mass-produced at a relatively low cost.

While my above description contains many specificities, these should not be construed as limitations on the scope, but rather as an exemplification of one [or several] embodiments(s) thereof. Many other variations are possible with regard to material and/or dimensional variations. It will be obvious to anyone with ordinary skills in the art that Lexan, Plexiglas, other synthetics, metal, wood, or paper products could be substituted for the acrylic sheet presently used for this structure. Other transparencies such as smoked, tinted, colored or frosted acrylic are optional alternatives. Thicknesses of the acrylic sheet could be altered to reduce production costs or to change the rigidity of the display rack. An extrusion process could be used in lieu of acrylic sheet. Obviously, the dimensions could be varied to modify the capacity of the rack or to change the interval between the individual caps' display. Also, the design of the bill retainer slots could be changed to squares, rectangles, triangles, v-shaped etc., as a method to anchor the cap's bills. The bill retainer slots could also be milled at varying depths to create an additional method of adjusting the degree of bill curvature.

Accordingly, the scope should not be determined by the embodiment(s) illustrated, but by the appended claims and their legal equivalents.

I claim:

1. A two piece sports cap display rack with adjustable bill shaper, in combination with a plurality of sports caps, the rack comprising:

a. a pair of identical, non-connected sidewall assemblies, interchangeable by design, each comprising:

b. a rear mounting flange, c. said rear mounting flange having a means of attachment to a vertical support structure and, d. a front bill retainer flange, e. said front bill retainer flange having a means for retaining a plurality of cap bills of the sports caps and the means for retaining comprising a plurality of bill retainer slots, f. a sidewall connecting said rear mounting flange and said front bill retainer flange also providing depth for storage of folded cap bodies of the plurality of sports caps, the sidewall extending transverse to both said rear mounting flange and said front bill retainer flange;

whereby one said sidewall assembly is inverted longitudinally 180 degrees from the other said sidewall assembly, properly spaced for the desired amount of bill curvature and mounted parallel to each other and at the same height, whereby the plurality of sports caps are displayed with a precise uniformity, presenting a crown indicia for artistic observation while simultaneously shaping the caps bills between a respective one of the bill retainer slots of both of the sidewall assemblies, providing substantial adjustability for the bill shaping process.

2. The display rack of claim 1 wherein the rear mounting flange of said sidewall assemblies are invaginated.

3. A two piece sports cap display rack with adjustable bill shaper, in combination with a plurality of sports caps, the rack comprising:

a. a pair of identical, non-connected sidewall assemblies, interchangeable by design, each comprising:

b. a rear mounting flange perforated with a plurality of apertures for attachment to a support structure using an appropriate fastening device such as woodscrews, wallboard fasteners, glue, double sided tape, c. a sidewall which provides depth for containment of a folded sports cap body or bodies of the plurality of sports caps, also providing a connecting medium for attachment of said rear mounting flange to a front bill retainer flange, the sidewall extending transverse to both said rear mounting flange and said front bill retainer flange, d. said front bill retainer flange encompassing a plurality of bill retainer slots for retention of a bill or bills of said folded cap bodies;

whereby one sidewall assembly is inverted longitudinally 180 degrees from the other said sidewall assembly, properly spaced for the desired amount of bill curvature and mounted parallel to each other and at the same height, whereby the plurality of sports caps are displayed with a precise uniformity, presenting a crown indicia for artistic observation while simultaneously shaping the caps bills between a respective one of the bill retainer slots of both of the sidewall assemblies, providing substantial adjustability for the bill shaping process.

4. The display rack of claim 3 wherein the rear mounting flange of said sidewall assemblies are invaginated.

* * * * *